US007255613B2

(12) United States Patent
Mackey et al.

(10) Patent No.: US 7,255,613 B2
(45) Date of Patent: Aug. 14, 2007

(54) CONNECTOR ASSEMBLY AND METHOD OF MAKING SAME

(75) Inventors: Dennis C. Mackey, Hamilton, MA (US); John J. Driscoll, Braintree, MA (US); Barbara J. Byczkiewicz, Westford, MA (US)

(73) Assignee: Rockwell Automation Technologies, Inc., Mayfield, OH (US)

( * ) Notice: Subject to any disclaimer, the term of this patent is extended or adjusted under 35 U.S.C. 154(b) by 0 days.

(21) Appl. No.: 11/240,280

(22) Filed: Sep. 30, 2005

(65) Prior Publication Data

US 2006/0270285 A1 Nov. 30, 2006

Related U.S. Application Data

(60) Provisional application No. 60/684,931, filed on May 25, 2005.

(51) Int. Cl.
*H01R 13/514* (2006.01)

(52) U.S. Cl. ..... 439/752; 439/736

(58) Field of Classification Search ..... 439/752, 439/736, 606, 595

See application file for complete search history.

(56) References Cited

U.S. PATENT DOCUMENTS 4,988,316 A * 1/1991 Roy ..... 439/744
5,017,163 A * 5/1991 Ohsumi ..... 439/752
5,098,315 A * 3/1992 Scowen ..... 439/587
5,186,662 A * 2/1993 Yuasa et al. ..... 439/752
5,189,788 A * 3/1993 Sakai et al. ..... 29/842
5,501,620 A * 3/1996 Ishii et al. ..... 439/752
5,603,642 A * 2/1997 Shinji et al. ..... 439/752
6,780,068 B2 * 8/2004 Bartholoma et al. ..... 439/752
6,994,598 B2 * 2/2006 Holmes et al. ..... 439/752.5

OTHER PUBLICATIONS 8 pictures of cross-sections of assorted connector assemblies, admitted prior art.

* cited by examiner

*Primary Examiner*—Gary F. Paumen
(74) *Attorney, Agent, or Firm*—Whyte Hirschboeck Dudek SC; William R. Walbrun

(57) ABSTRACT

An electrical connector, electrical connection assembly implementing at least one such electrical connector, and method of making such an electrical connector are disclosed. The method includes attaching a wire to a conductive component that includes at least one of a pin and a socket, positioning the conductive component into a supporting structure, and positioning a retaining component in relation to the supporting structure, where the retaining component serves to substantially prevent relative movement of the conductive component relative to the supporting structure. The method further includes overmolding at least portions of the supporting structure and the wire.

22 Claims, 6 Drawing Sheets

CONNECTOR ASSEMBLY AND METHOD OF MAKING SAME

CROSS-REFERENCE TO RELATED APPLICATIONS

This application claims the benefit of U.S. Provisional Application Ser. No. 60/684,931 filed on May 25, 2005, the teachings and disclosures of which are incorporated by reference herein.

STATEMENT REGARDING FEDERALLY SPONSORED RESEARCH OR DEVELOPMENT

FIELD OF THE INVENTION

The present invention relates to connectors and connector assemblies, and particularly, connector assemblies used in electrical applications such as electrical power distribution and electrical communications networks.

BACKGROUND OF THE INVENTION

Electrical connector assemblies, which allow for the connection of one or more electrical nodes or lines with one or more other electrical nodes or lines, are ubiquitous in a variety of electronics applications. Among these are applications involving electrical power distribution as well as applications involving electronic communications such as computer networks.

Commonly, electrical connector assemblies include male and female connectors, the former having pins and the latter having complementary sockets. Further, one known manner of manufacturing such male and female connectors involves the fitting of metallic pins or sockets into plastic support structures or "inserts," where the plastic inserts have complementary holes for receiving the pins/sockets. When the pins/sockets are fully assembled into the plastic inserts, the pins/sockets extend beyond their complementary holes and outward from one or more surfaces of the plastic inserts such that contacting ends of the pins/sockets can receive/be received by complementary sockets/pins.

Also, typically extending from the ends of the pins/sockets opposite to their contacting ends are leads or wires, which often are crimped within recesses of the pins/sockets so as to affix the wires to the pins/sockets. Thus, the final positioning of the pins/sockets and wires on a connector typically is such that pins/sockets extend from a surface proximate one end of the connector and wires (or a cable) extend from a surface proximate the other end, where the pins/sockets and portions of the wires are generally supported by and positioned within the plastic inserts.

When the pins/sockets and wires are in place with respect to an insert, an overmolding step typically is performed upon a large portion of the insert so as to more fully and permanently lock the pins/sockets and corresponding wires in place with respect to the plastic insert. The overmolding step often involves encapsulating the end of the insert from which the wires extend in a plastic or rubber-type material.

One difficulty in manufacturing connector assemblies in this manner involves the tendency of the pins/sockets and corresponding wires to fall out of the complementary holes within the plastic inserts prior to the application of the overmolding. This tendency conventionally is overcome in one of two manners. One manner involves forcibly locking the pins/sockets into place within their complementary holes within the plastic inserts. A second manner involves, prior to the application of the overmolding, the application of a glue-type material often termed "hot melt" to lock the pins/sockets in place with respect to the plastic inserts.

Each of these conventional manners of securing the pins/sockets and corresponding wires in place with respect to the plastic inserts is disadvantageous. The first manner involving forcible insertion of the pins/sockets is undesirable at least insofar as the insertion process is difficult to standardize and often must be done by hand. As a result, the process can be time-consuming and costly to perform. The second manner involving the application of hot melt is undesirable at least insofar as it requires an additional manufacturing step that takes additional time to perform and also can be messy.

For at least these reasons, therefore, it would be desirable if a new type of connector (and/or connector assembly) was developed that could be manufactured without the need for either manual insertion of pins/sockets into plastic inserts or the application of hot melt. Further, it would be desirable if the new type of connector had the same external capabilities as conventional connectors, both in terms of its connectability with other connectors (and/or other complementary terminals), and also in terms of its robustness.

BRIEF SUMMARY OF THE INVENTION

The present inventors have recognized the need for an improved connector/connector assembly and related manufacturing process, and have further realized that an improved connector could be manufactured through the use of one or more locking rings or similar components that slipped over (or otherwise around) the pins/sockets and/or corresponding wires in relation to the plastic insert and locked the pins/sockets and/or wires in relation to the plastic insert.

More particularly, the present invention relates to an electrical connector capable of being coupled to another connection device. The electrical connector includes an insert having a first end and a second end, where the insert is configured to interface the other connection device at the first end. The electrical connector further includes a conductive component that is at least partly supported by the insert, where the conductive component includes a portion that is exposed proximate the first end such that the portion is capable of being coupled to another portion of the other connection device, and where the conductive component extends outward out of and away from the second end of the insert. The electrical connector additionally includes a retaining component that extends between the insert and the conductive component and substantially prevents relative movement of the insert and at least a part of the conductive component. The electrical connector further includes overmolding material that encapsulates at least portions of the conductive component and the insert, so as to further substantially prevent relative movement of the insert and the part of the conductive component.

Additionally, the present invention relates to a connection assembly that includes a first connector and a second connector. The first connector includes a support portion, a conductive portion, means for substantially preventing relative movement of the support portion and the conductive portion, and overmolding material surrounding at least a portion of the first connector. Also, the second connector is coupled to the first connector, and one of the first and second connectors is a male connector and the other of the first and second connectors is a female connector.

Further, the present invention relates to a method of making a connector. The method includes attaching a wire to a conductive component that includes at least one of a pin and a socket, positioning the conductive component into a supporting structure, and positioning a retaining component in relation to the supporting structure, where the retaining component serves to substantially prevent relative movement of the conductive component relative to the supporting structure. The method additionally includes overmolding at least portions of the supporting structure and the wire.

DETAILED DESCRIPTION OF THE PREFERRED EMBODIMENT

Figure 1:
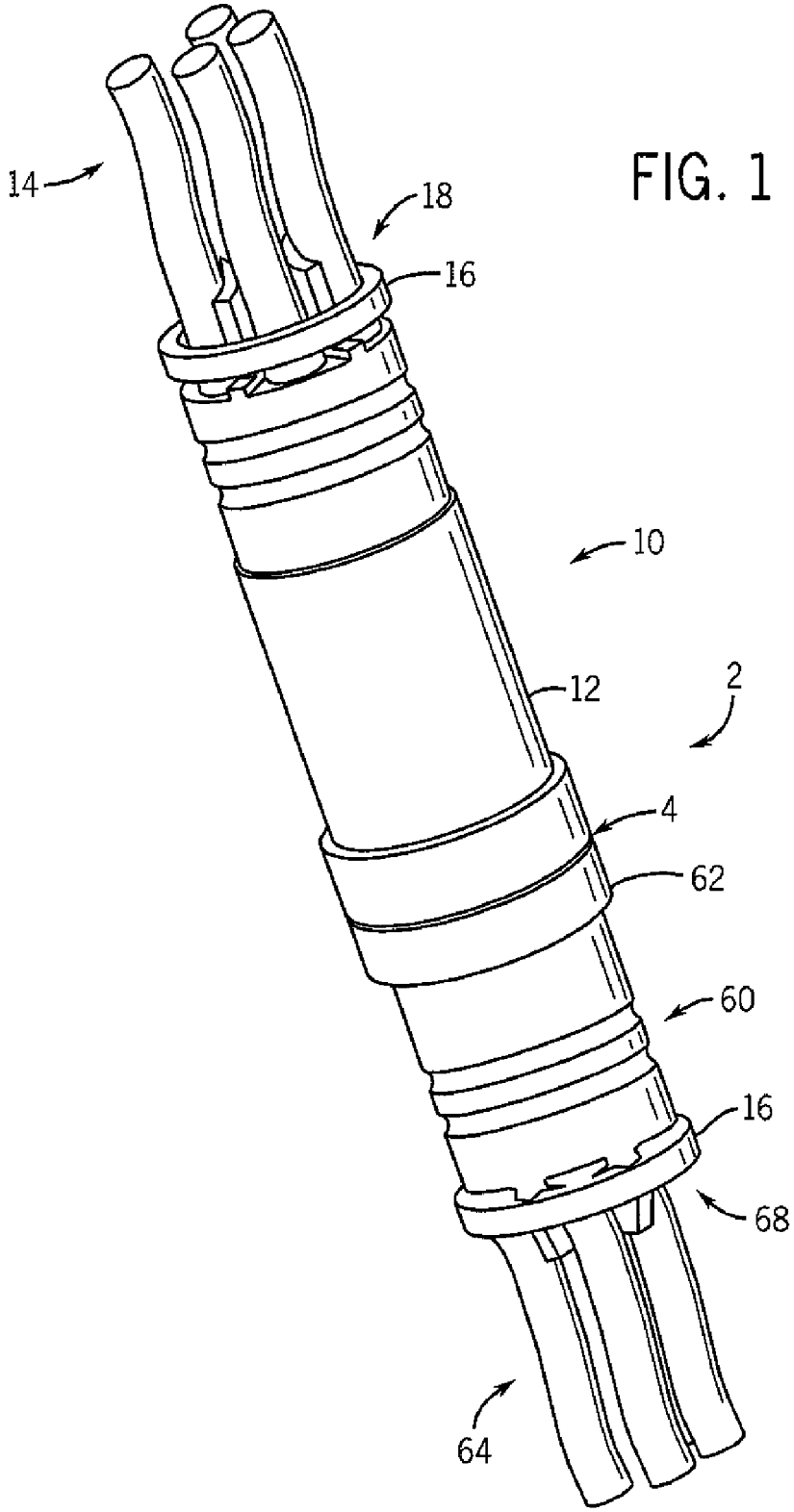
FIG. 1 is a perspective view of an assembly of exemplary male and female connectors, where the male and female connectors are shown in a partially-formed state, prior to overmolding of the connectors.

Referring to FIG. 1, a partially-completed connector assembly 2 having a male connector 10 and a female connector 60 is shown. As will be discussed in further detail below, the connector assembly 2, and the connectors 10, 60, are only partially-assembled insofar as neither of the connectors 10, 60 have been "overmolded." Nevertheless, notwithstanding the lack of overmolding, the partially-completed male and female connectors 10, 60, which are complementary, can still be coupled together as shown in FIG. 1.

Further as shown in FIG. 1, each of the male and female connectors 10, 60 includes a respective plastic insert 12, 62. When coupled to one another, the male and female connectors 10, 60 interface one another along a junction 4 between the plastic inserts 12, 62. Although the inserts 12, 62 in the present embodiment are described as being plastic, in alternate embodiments the inserts 12, 62 could be made from other materials, preferably electrically insulating materials.

The connectors 10 and 60 respectively serve to connect two sets of wires 14 and 64, respectively, which extend outward from the male and female inserts 12 and 62, respectively. In the present embodiment, the sets of wires 14, 64 each include four wires, although in alternate embodiments any number of wires could extend outward away from the connectors 10, 60. Also as shown, and as will be described in further detail below, each of the male and female connectors 10, 60 includes a non-metallic molded part shown as rings 16. The respective ring 16 of each of the connectors 10,60 extends around the respective wires 14,64 of the respective connector, proximate outer ends 18 and 68 of the inserts 12 and 62, respectively. In alternate embodiments, the rings 16 (or other parts in place of such rings, as discussed further below) need not be molded, but rather could be, for example, stamped or machined.

Figure 2:
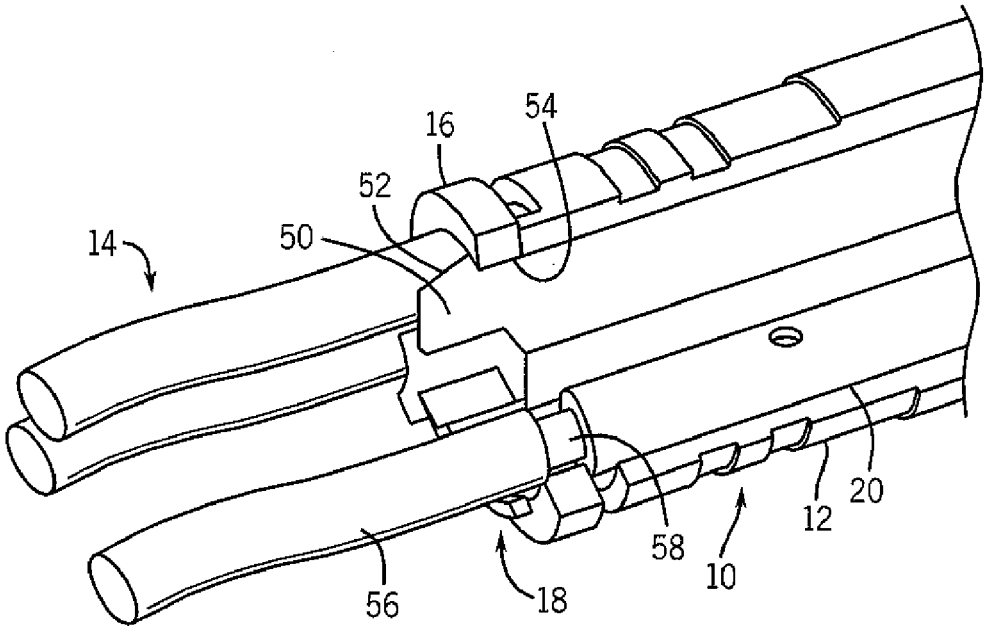
FIG. 2 is a perspective view of a portion of the exemplary male connector of FIG. 1 in partial cutaway to reveal in more detail an interrelationship between a plastic insert, pins, wires and a locking ring of the connector.
Figure 3:
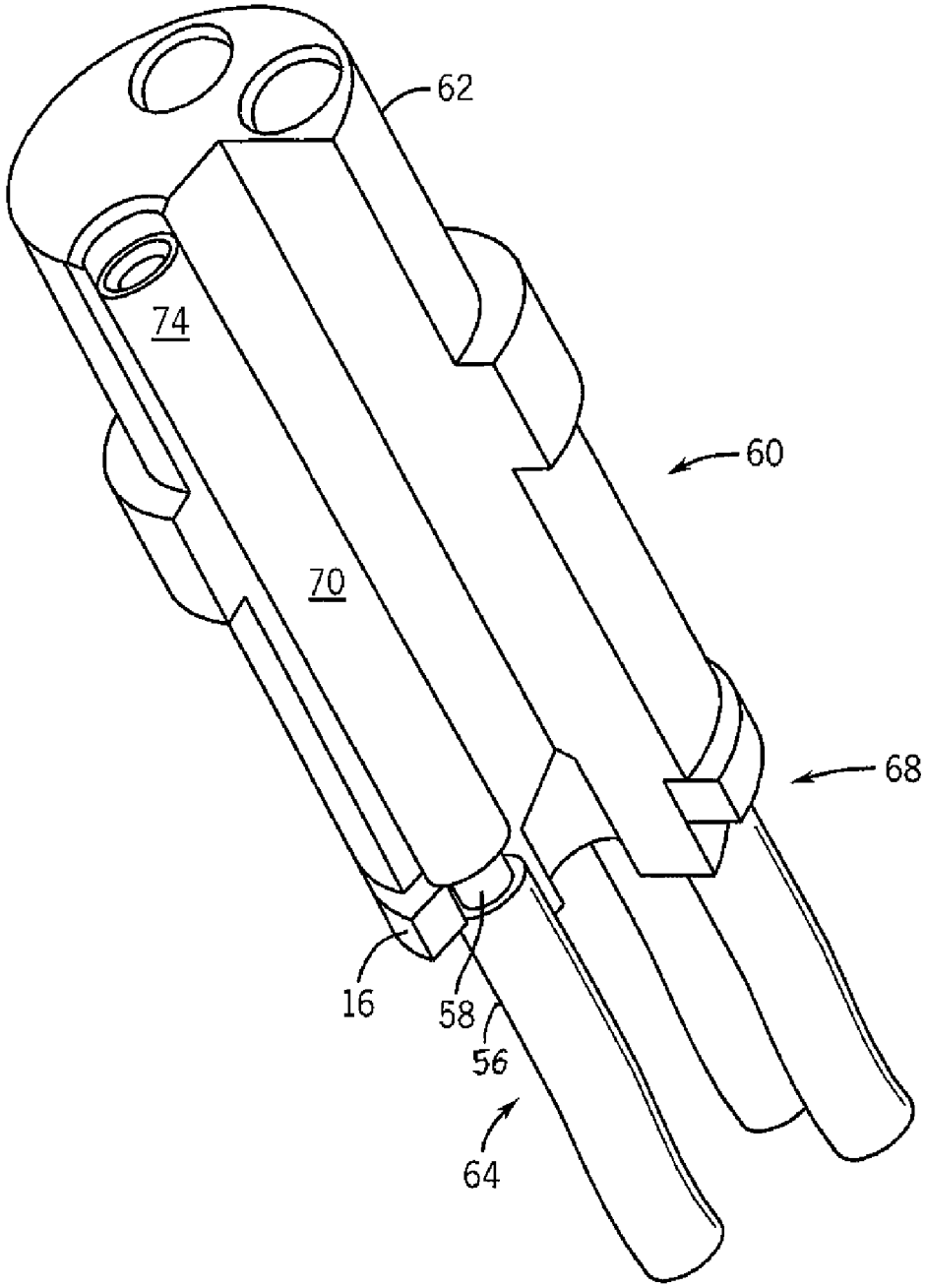
FIG. 3 is a perspective view of the exemplary female connector of FIG. 1 in partial cutaway to reveal in more detail an interrelationship between a plastic insert, sockets, wires and a locking ring of the connector.
Figure 4:
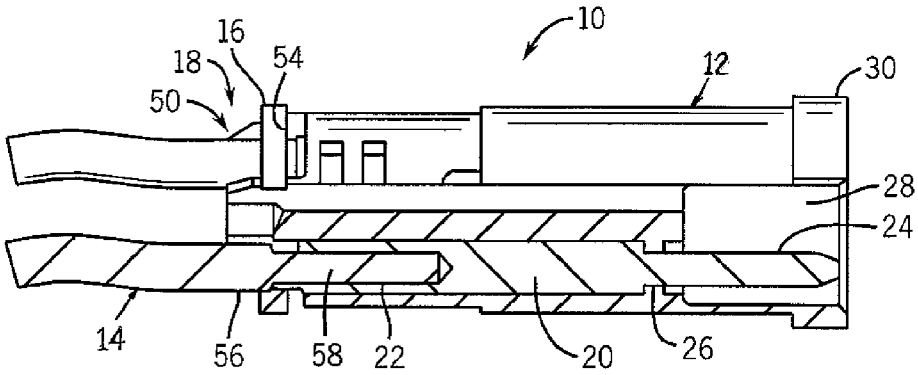
FIG. 4 is a cross-sectional view of the exemplary male connector of FIGS. 1 and 2.
Figure 5:
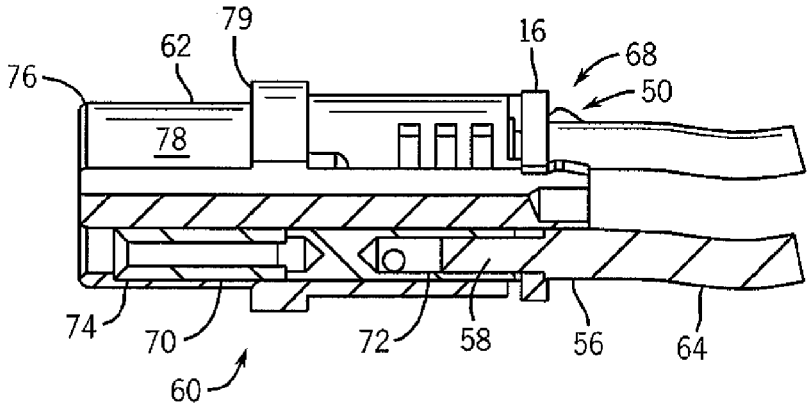
FIG. 5 is a cross-sectional view of the exemplary female connector of FIGS. 1 and 3.

Turning to FIGS. 2-5, the partially-completed male and female connectors 10 and 60 are shown in further detail. In particular, FIG. 2 shows a perspective view of a portion of the male connector 10 with approximately a quarter of the connector removed so as to reveal certain internal components of the male connector, and FIG. 4 further shows an additional cross-sectional view of the male connector 10. Similarly, FIG. 3 provides a perspective view of the female connector 60 with approximately a quarter of the connector removed so as to reveal certain internal components of the female connector, and FIG. 5 provides an additional cross-sectional view of the female connector.

As shown in FIGS. 2 and 4, in the male connector 10, the wires 14 extend inward into the insert 12 so as to penetrate and rest within respective pins such as a first pin 20. Each of the pins 20 (only one being visible in FIGS. 2 and 4) includes a receiving hole 22 (see FIG. 4) that receives the respective wire 14 at one end of the pin 20 and, at a second end of the pin, includes a protruding portion 24. While most of the pin 20 including the receiving hole 22 is surrounded by and supported within the insert 12, the protruding portion 24 extends through a hole 26 in the insert 12 and subsequently extends outward within a receiving atrium 28 of the insert toward an interfacing end 30 that helps to form the junction 4 of FIG. 1. The wires 14 are locked in place in relation to their respective pins 20 due to crimping of the pins once the wires have been placed within the receiving holes 22 of the pins.

Similarly, referring to FIGS. 3-5, the female connector 60 includes multiple sockets such as a socket 70 that is supported within the insert 62. As shown, the socket 70 (like each of the other sockets, which are not visible) also includes a receiving hole 72 that receives a respective one of the wires 64. At the end of the socket 70 opposite the end at which the receiving hole 72 is located, the socket includes a receiving portion 74 having an inner diameter that is complementary to an outer diameter of the protruding portion 24 of the pin 20, such that the protruding portion 24 can fit snugly within the receiving portion 74. The wires 64 are locked in place in relation to their respective sockets 70 due to crimping of the sockets once the wires have been placed within the corresponding receiving holes 72 of the sockets.

The plastic insert 62 at an end 76 includes a filling portion 78 that can fit at least partly within the atrium 28 of the insert 12. Thus, during assembly of the male connector 10 with the female connector 60, the protruding portion 24 of the pin 26 extends into the receiving portion 74 of the socket 70, and also the filling portion 78 of the insert 62 extends into the atrium 28 of the insert 12. Further, upon such assembly of the connectors 10,60, the interfacing end 30 of the male connector 10 interfaces an additional interfacing edge 79 of the female connector 60, thereby forming the junction 4.

Figure 6:
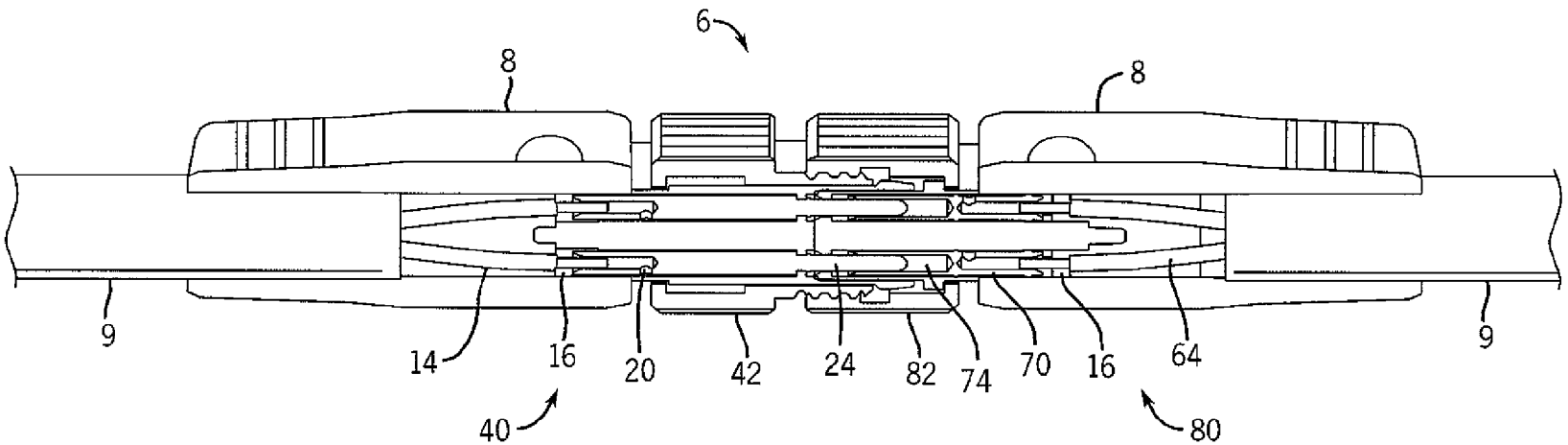
FIG. 6 is a front elevation, partial cross-sectional, view of a connector assembly formed by exemplary male and female connectors, where the connectors are completely formed in contrast to those of FIG. 1.

FIG. 6 in contrast to FIG. 1 shows a connector assembly 6 that is formed from a fully-completed male connector 40 and a fully-completed female connector 80, where the fully-completed connectors are simply the partially-completed connectors 10 and 60 that additionally include overmolding 8 and male and female locking nuts 42 and 82, respectively, as shown. The overmolding 8 is typically a plasticized or rubberized material that has been placed around the connectors 10,60 so as to result in the connectors 40,80, but it should be understood that overmolding can include other materials as well. Application of the overmolding 8 results in connectors that are more stable and robust, particularly in terms of maintaining the positions of the wires 14,64 and pins/sockets 20/70 in relation to the inserts 12,62.

In particular, the overmolding 8 typically encapsulates at least portions of the connectors 10,60 proximate the outer ends 18,68 of the inserts 12,62 and portions of the wires 14,64 extending therefrom. More specifically, in the embodiment shown, the wires 14, 64 extending away from the inserts 12,62 are contained within cable sheaths 9, and consequently the overmolding 8 actually is in contact with cable sheaths 9 that surround the multiple wires 14,64 in addition to being in contact with portions of the inserts 12,62.

Also as shown in FIG. 6, the male and female locking nuts 42,82 are designed such that, when the connectors 40, 80 are assembled to one another, a protruding portion of the male locking nut that is threaded along its outer diameter can be rotated with respect to a complementary receiving portion of the female locking nut that is threaded along its inner diameter, so as to lock together the connectors 40,80. The locking nuts 42,82 can be made from a number of materials, such as various plastics or metals.

FIG. 6 shows the connectors 40,80 again in partial cutaway so as to reveal one entire electrical linkage that is formed when the connectors are assembled to one another. As shown, the electrical linkage begins with one of the wires 14 that extends into one of the pins 20 of the male connector 40. The protruding portion 24 of the pin 20 in turn protrudes into the complementary receiving portion 74 of the corresponding socket 70 of the connector 80, where the socket 70 in turn is coupled to one of the wires 64.

Although FIGS. 2-6 show in particular only one of the pins 20 and/or one of the sockets 70, it will be understood that the connectors 10, 40, 60 and 80 each actually includes four pins 20 or four sockets 70 corresponding to the respective four wires 14 and 64, respectively. In alternate embodiments, each of the connectors could instead be designed to have any number of pins or sockets corresponding to any number of wires, ranging from one to a number considerably greater than four (e.g., nine or more).

Further referring to FIGS. 2-6, and as discussed above with respect to FIG. 1, the connectors 10 and 60 (as well as the connectors 40 and 80) each include a non-metallic molded part or ring 16 that, upon assembly with respect to its respective connector, extends circumferentially around its respective insert 12,62 and also around its respective wires 14,64, at a location proximate the outer ends 18,68. The rings 16 serve to lock the wires 14,64, pins 20 and sockets 70 in place with respect to the plastic inserts 12 and 62, respectively.

In the present embodiment, the rings 16 are positioned in relation to the inserts 12,62 after the pins 20 and sockets 70 (with their respective wires attached thereto) are positioned within the respective inserts 12, 62. Once the pins 20/sockets 70 are in place, the rings 16 (which are initially positioned somewhere along the wires 14,64) are then slid toward the inserts 12,62 toward and inward slightly past the outer ends 18,68 of the inserts.

As shown particularly in FIG. 2 as well as in FIGS. 4 and 5, the inserts 12,62 proximate the outer ends 18,68 include outwardly extending protrusions 50 over which the rings 16 slide as they move slightly past the outer ends 18, 68. In the embodiment shown, the protrusions 50 generally take the form of an X when viewed axially inwardly towards the outer ends 18,68, such that the four wires 14,64 extending into the respective insert 12,62 are separated from one another by the protrusions 50 into four quadrants determined by those protrusions.

Further, each of the four protrusions 50 has an increasing radius 52 (see FIG. 2) as one proceeds farther inward, up to a respective indentation 54 in which the radius then abruptly decreases again. Consequently, as the ring 16 is slid inward over its respective insert 12,62, the ring first encounters progressively increased resistance causing the ring to be deformed slightly outwards and then slips into place around the indentations 54 of the protrusions 50, allowing the ring 16 to substantially return to its undeformed shape. The rings 16 thus can be thought of as snap rings that snap into place around the indentations 54.

Once the ring 16 is in this resting position, and consequently is locked into/onto the inserts 12,62, it not only rests within the indentations 54, but also applies pressure to the wires 14,64 so as to lock the wires and their corresponding pins 20/sockets 70 in place with respect to the insert 12, 62. Thus, because of the rings 16, it is not necessary for the pins 20 and sockets 70 to be sized so as to establish interference fits with respect to the complementary holes in the inserts 12,62 in order to lock those pins/sockets in place, nor is it necessary to lock those pins/sockets in place using hot melt or other adhesive.

In the embodiment shown in FIGS. 2-6, at least portions of the rings 16 rest along insulative portions 56 of the wires 14,64, such that the pressure of the rings 16 is applied to the insulation portions of the wires. Because the insulative portions 56 have larger outer diameters than conductive portions 58 surrounded by those insulative portions 56, the rings tend to apply greater force to the wires 14,64 to hold those wires in place than would be the case if the rings only encountered the conductive portions 58.

Nevertheless, in alternate embodiments, the relative positioning of the rings 16 and the wires 14,64 would be such that the rings would not interface the insulative portions 56 but rather would be positioned merely alongside exposed conductive portions 58 of the wires that exist between the ends of the insulative portions and the pins 20/sockets 70 into which those wires are crimped. In such embodiments, the rings 16 would apply less (or no) pressure to the wires 14,64. Nevertheless, the rings 16 would still serve the purpose of locking the pins 20/sockets 70 and their corresponding wires 14,64 in place insofar as the rings would still prevent backsliding of the pins/sockets (given their larger diameter relative to the conductive portions of the wires) and also prevent backsliding of the wires due to the crimping of the wires within the pins/sockets.

Figure 7:
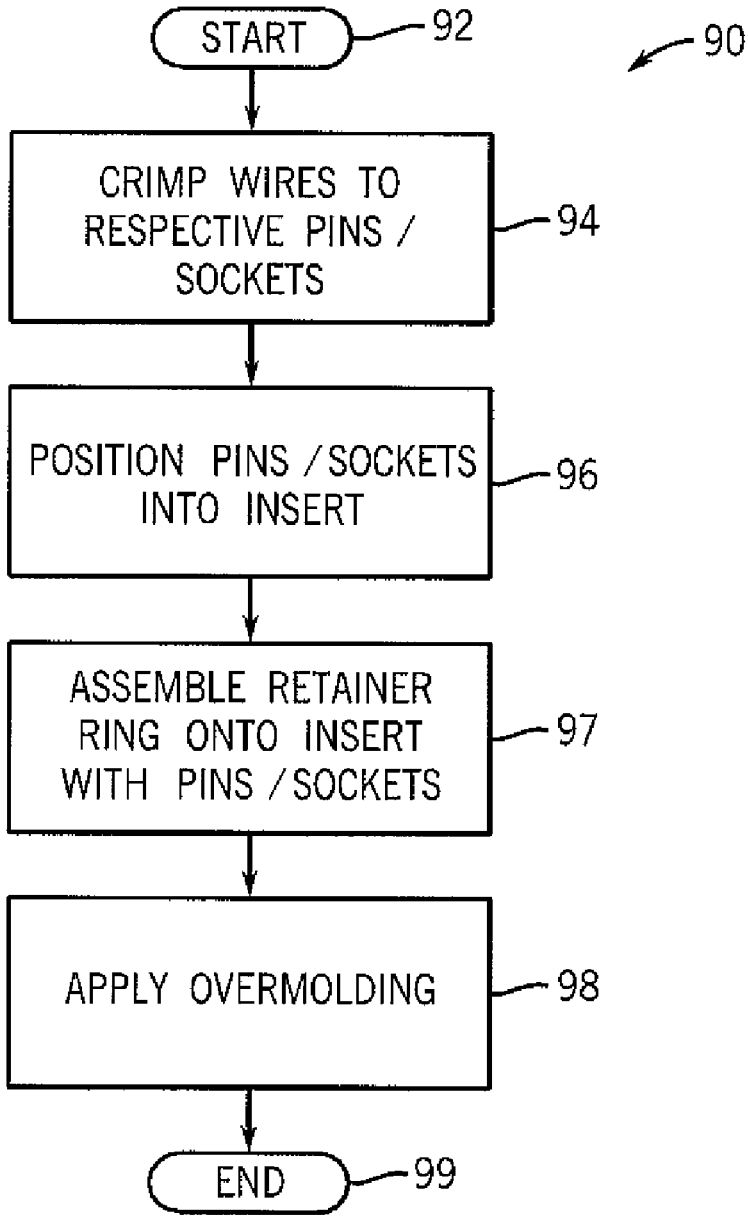
FIG. 7 is a flow chart showing steps of an exemplary process for making connectors, in accordance with certain embodiments of the present invention.

Turning to FIG. 7, a flowchart 90 shows exemplary steps of a process for forming a connector such as the connectors 40,80 discussed above. Starting at a step 92, the process of manufacturing the connectors first involves crimping wires within their respective pins/sockets at a step 94. Then, the pin/sockets are positioned into an appropriate insert, at a step 96. Further, at a step 97, the retainer rings 16 are slid from over the wires and onto the insert so as to lock the pins/sockets and their corresponding wires in place with respect to the insert.

Finally, at a step 98, overmolding is then applied to completely lock the pins/sockets and wires (and the rings) in place permanently, where the overmolding in particular is applied proximate the junction of the inserts and the wires. The process is then completed at a step 99. Although not shown in FIG. 7, the male and female locking nuts shown in FIG. 6 would typically be positioned onto the inserts prior to the positioning of the pins/sockets in step 96 (or, alternately, prior to or as part of step 97).

Although certain embodiments of the present invention are shown and discussed with reference to FIGS. 1-7, the present invention is intended to encompass a variety of other embodiments in addition to those shown and discussed above. For example, while in the above embodiments it is intended that the pins/sockets be slip fit into the inserts 12,62, in alternate embodiments the pins/sockets could be press fit into those inserts. Also, while the present embodiment each connector has only pins or sockets, in some alternate embodiments it is possible that a given connector could have both one or more pins and one or more sockets.

Also, while in the above-described embodiments the rings 16 are slid onto the inserts to lock the pins/sockets and wires after the pins/sockets and wires are positioned onto the inserts, in alternate embodiments the rings could be assembled to the inserts prior to the introduction of the pins/sockets and wires. In such embodiments, introduction of the pins/sockets and wires would cause deformation of the rings as the pins/sockets/wires were introduced, and yet the rings would still serve to lock in place the pins/sockets/wires after those components were positioned into the inserts.

Further, although in the embodiments described above the rings 16 are locked into position when the rings pass into the indentations 54, in alternate embodiments the rings could be affixed in place in relation to the inserts in alternate manners, for example, by way of adhesives, ultrasonics, heat or pressure. To the extent that the rings do snap into indentations such as those discussed above, the indentations need not always be in the insert, but also instead (or additionally) could be positioned on the pins/sockets or even the wires.

Also, while the above-described process envisions the assembly and formation (including overmolding) of connectors on an individual basis (e.g., one male connector or one female connector at a time), the present invention also in other embodiments encompasses process in which pairs of connectors (e.g., a male and a female connector) or even greater numbers of connectors are assembled simultaneously. For example, a pair of complementary male and female connectors as shown in FIGS. 2 and 3, respectively, could be assembled together as shown in FIG. 1 and then overmolding could be applied to both connectors simultaneously.

Also, while in the present embodiment the non-metallic molded parts used to lock the pins/sockets and wires in place relative to the inserts is in the form of the rings 16, in alternate embodiments the rings could be replaced with locking components that had other shapes, for example, oval shapes, rectangular shapes, C-shapes (e.g., a C-clip), hexagonal shapes (e.g., a hex shaped ring), or a molded cap with holes. Additionally, any of these locking devices could have axial lengths or thicknesses that varied from that of the rings 16 shown in the FIGS. Further, where the locking devices are designed to snap into place due to interactions with indentations such as the indentations 54, those indentations and, indeed the various structural formations of the inserts 12,62 could vary from those shown.

Further, other shapes of the components of the connectors could vary from those shown. In some embodiments, the overmolding will be applied in such a manner that the wires (and cables containing the wires) would be diverted from the generally axial paths away from the inserts 12,62 shown in the FIGS. For example, the overmolding could be applied so as to result in wires that extended away from the inserts at approximately 90 degree angles relative to the directions shown in the FIGS. Additionally, a variety of different materials can be used for the components of the connectors in place of those discussed above, albeit the materials used should generally be electrically insulative in the case of the inserts 12,62.

Also, while overmolding is used in the above-discussed embodiments, other techniques could also be used to encase/encapsulate/seal the connectors (and, more particularly, to encase/encapsulate/seal the inserts 12,62 with respect to their respective wires 14,64/cables) so as to improve the robustness of the connectors. For example, in some other embodiments, other known types of sealants or even a shrinkwrap-like material could be utilized. In other embodiments, a hard shell could be placed around the appropriate portions of the connectors and wires extending therefrom, and then the space within the shell between the shell and the connectors/wires could be filled with a potting material or other filler. Additionally, in some other embodiments, terminal chambers as are known in the art could be utilized.

Finally, while the present invention relates to electrical connectors and connector assemblies for use in applications such as electrical power distribution applications and electronic forms of communication such as computer networks, the present invention also in some other embodiments could be employed in relation to other types of connectors. For example, the present invention could also be implemented in relation to connectors for optical systems (e.g., connecting fiber optical cables).

It is specifically intended that the present invention not be limited to the embodiments and illustrations contained herein, but include modified forms of those embodiments including portions of the embodiments and combinations of elements of different embodiments as come within the scope of the following claims.

We claim:

1. An electrical connector capable of being coupled to another connection device, the electrical connector comprising:

an insert having a first end and a second end, wherein the insert is configured to interface the other connection device at the first end;

a conductive component that is at least partly supported by the insert, wherein the conductive component includes a portion that is exposed proximate the first end such that the portion is capable of being coupled to another portion of the other connection device, and wherein the conductive component extends outward out of and away from the second end of the insert;

a retaining component that extends entirely and continuously around a perimeter of the insert and around the conductive component and substantially prevents relative movement of the insert and at least a part of the conductive component; and overmolding material that encapsulates at least portions of the conductive component and the insert, so as to further substantially prevent relative movement of the insert and the part of the conductive component.

2. The electrical connector of claim 1, wherein the retaining component is locked into place with respect to the insert due to the positioning of the retaining component within at least one indentation of the insert.

3. The electrical connector of claim 2, wherein the retaining component is a ring-shaped component.

4. The electrical connector of claim 3, wherein the retaining component is a snap ring that snaps into a plurality of indentations in the insert after the snap ring has been slid over a plurality of outwardly tapering flanges of the insert.

5. The electrical connector of claim 1, wherein the conductive component includes a wire and at least one of a pin and a socket.

6. The electrical connector of claim 5, wherein the at least one pin and socket includes a receiving hole, wherein a portion of the wire extends into the receiving hole, and wherein the at least one pin and socket is crimped such that the wire is substantially fixed in position in the receiving hole.

7. The electrical connector of claim 5, wherein the portion that is exposed is an end portion of the at least one pin and socket.

8. The electrical connector of claim 7, wherein the exposed portion is configured to be coupled to a complementary exposed portion of another pin or socket.

9. The electrical connector of claim 7, wherein the exposed portion is the end portion of the pin, and the end portion extends within an atrium formed within the first end of the insert.

10. The electrical connector of claim 5, wherein the wire extends outward out of the second end of the insert.

11. The electrical connector of claim 5, further comprising at least one additional conductive component, wherein each of the at least one additional conductive component includes a respective wire and one of a respective pin and a respective socket.

12. The electrical connector of claim 5, wherein the retaining component applies pressure to insulation on the wire, thereby preventing movement of the wire and the at least one pin and socket in relation to the insert.

13. The electrical connector of claim 5, wherein the retaining component at least partly extends within a gap existing between an insulative sheathe on the wire and the at least one pin and socket, wherein the retaining component prevents substantial backsliding of the at least one pin and socket out of the insert, and wherein the prevention of backsliding by the retaining component further substantially prevents relative movement of the wire away from the insert.

14. The electrical connector of claim 5, wherein the retaining component is slid onto the insert subsequent to the positioning of the at least one pin and socket into the insert.

15. The electrical connector of claim 5, wherein the at least one pin and socket are positioned into the insert subsequent to securing of the retaining component onto the insert.

16. The electrical connector of claim 5, wherein at least one of the following is true:

the at least one pin and socket is slip fit into the insert;

the at least one pin and socket is interference fit into the insert; and the electrical connector includes at least one of a male and a female locking nut for locking the electrical connector in contact with the other connecting device.

17. A connection assembly comprising:

a first connector, wherein the first connector includes a support portion, a conductive portion supported by the support portion, and means for substantially preventing relative movement of the support portion and the conductive portion, wherein the means for substantially preventing relative movement extends entirely and continuously around a perimeter of the support portion; and a second connector coupled to the first connector, wherein one of the first and second connectors is a male connector and the other of the first and second connectors is a female connector;

wherein overmolding material at least partially surrounds at least a portion of at least one of the first connector and the second connector.

18. The electrical connection assembly of claim 17, wherein the connection assembly is an electrical connection assembly and serves to communicate at least one of network communication signals and power between the first and second connector.

19. A method of making a connector, the method comprising:

attaching a wire to a conductive component that includes at least one of a pin and a socket;

positioning the conductive component into a supporting structure;

positioning a retaining component in relation to the supporting structure, wherein the retaining component serves to substantially prevent relative movement of the conductive component relative to the supporting structure, and wherein the retaining component extends entirely and continuously around a perimeter of the support structure; and overmolding at least portions of the supporting structure and the wire.

20. The method of claim 19, wherein the wire is attached to the conductive component by inserting the wire into a receiving hole within the conductive component and then crimping the conductive component, and wherein the retaining component is a snap ring that fits within indentations within the supporting structure.

21. An electrical connector capable of being coupled to another connection device, the electrical connector comprising:

an insert having a first end and a second end, wherein the insert is configured to interface the other connection device at the first end;

a conductive component that includes one of a pin and a socket and that is supported by the insert, wherein the conductive component includes a first portion that is exposed proximate the first end and a second portion proximate the second end;

a retaining component that extends around the conductive component and entirely and continuously around a perimeter of the insert, wherein the retaining component is coupled to the insert and applies pressure to the conductive component so that the conductive component is retained in relation to the insert and continues to be supported by the insert; and overmolding material that encapsulates at least portions of the conductive component and the insert, so as to further assist in retaining the conductive component in relation to the insert.

22. The electrical connector of claim 21, wherein the retaining component defines an orifice, wherein the conductive component is positioned along an axis within the insert, wherein the axis extends through the orifice, and wherein the retaining component substantially prevents movement of the conductive component along the axis through the orifice away from the insert.

* * * * *